US006681432B1

(12) United States Patent
Reinhold

(10) Patent No.: US 6,681,432 B1
(45) Date of Patent: Jan. 27, 2004

(54) GANGWAY

(76) Inventor: Günter Reinhold, Bergmannstrasse 64, 80339 München (DE)

( * ) Notice: Subject to any disclaimer, the term of this patent is extended or adjusted under 35 U.S.C. 154(b) by 0 days.

(21) Appl. No.: 10/030,864

(22) PCT Filed: May 14, 2000

(86) PCT No.: PCT/DE00/01516

§ 371 (c)(1),
(2), (4) Date: Apr. 26, 2002

(87) PCT Pub. No.: WO01/87702

PCT Pub. Date: Nov. 22, 2001

(51) Int. Cl.[7] ..... E01D 1/00
(52) U.S. Cl. ..... 14/69.5
(58) Field of Search ..... 14/2.4, 2.5, 18, 14/69.5, 77.1; D34/32

(56) References Cited

U.S. PATENT DOCUMENTS

| | | | | | |
|---|---|---|---|---|---|
| 31,147 | A | * | 1/1861 | Bell | 14/69.5 |
| 132,442 | A | * | 10/1872 | Clarke | 212/309 |
| 233,160 | A | * | 10/1880 | Mooney | 14/69.5 |
| 308,867 | A | * | 12/1884 | Ayres | 14/70 |
| 2,016,191 | A | * | 10/1935 | Cordova | 14/18 |
| 2,339,925 | A | * | 1/1944 | Haupt | 14/18 |
| 4,457,035 | A | * | 7/1984 | Habegger et al. | 14/18 |

FOREIGN PATENT DOCUMENTS

| | | |
|---|---|---|
| DE | 198 20 780 | 9/1999 |
| FR | 2 528 004 | 12/1983 |
| JP | 8-184009 | * 7/1996 |

* cited by examiner

*Primary Examiner*—Gary S. Hartmann
(74) *Attorney, Agent, or Firm*—Collard & Roe, P.C.

(57) ABSTRACT

A gangway and method for producing a gangway for use at variable angles of inclination. The gangway has a plurality of trapezoidal steps flexibly secured to a plurality of sides. A plurality of railing posts are rigidly secured to the trapezoidal steps and flexibly secured to a handrail. The railing posts have a concave shaped portion adjacent to the trapezoidal steps which prevents contact between the railing posts and the trapezoidal steps as the trapezoidal steps are displaced when the inclination of the gangway changes. A plurality of runners are secured at an acute angle to the underside of the gangway sides. The distance between the runners is smaller than the distance between the sides of the gangway, reducing the difference in degrees of inclination between the gangway sides as a pontoon on which an end of the gangway rests lists.

18 Claims, 6 Drawing Sheets

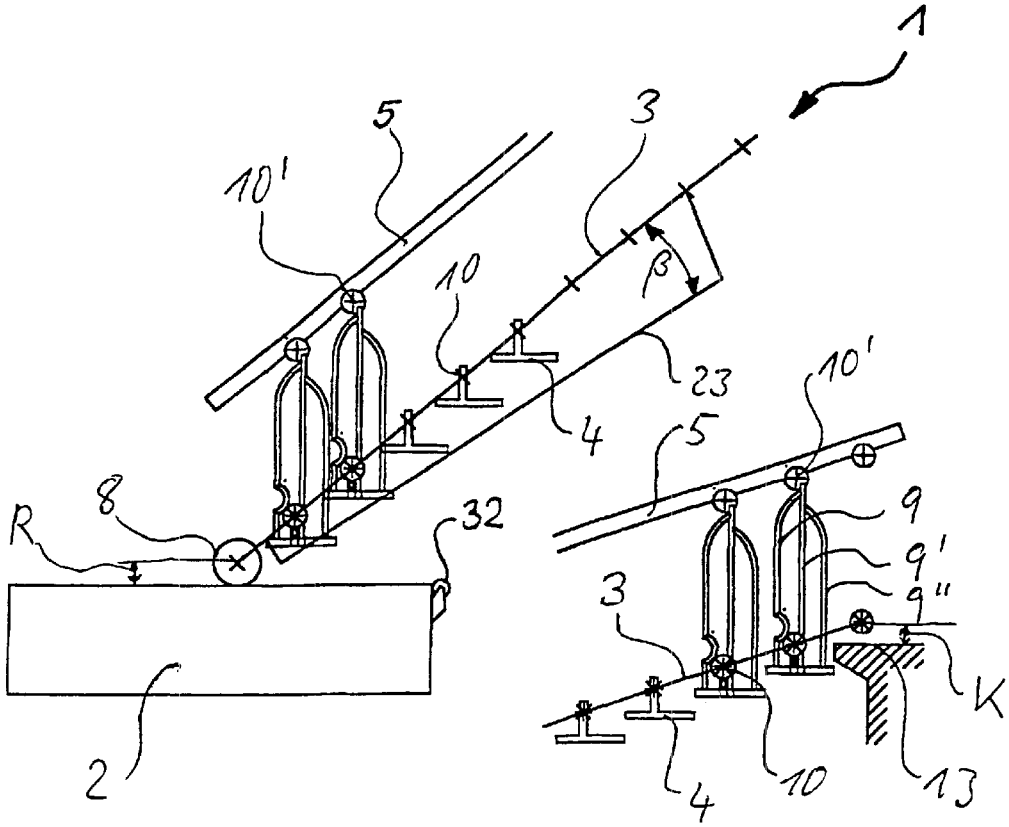
Fig. 2a
Fig. 2b
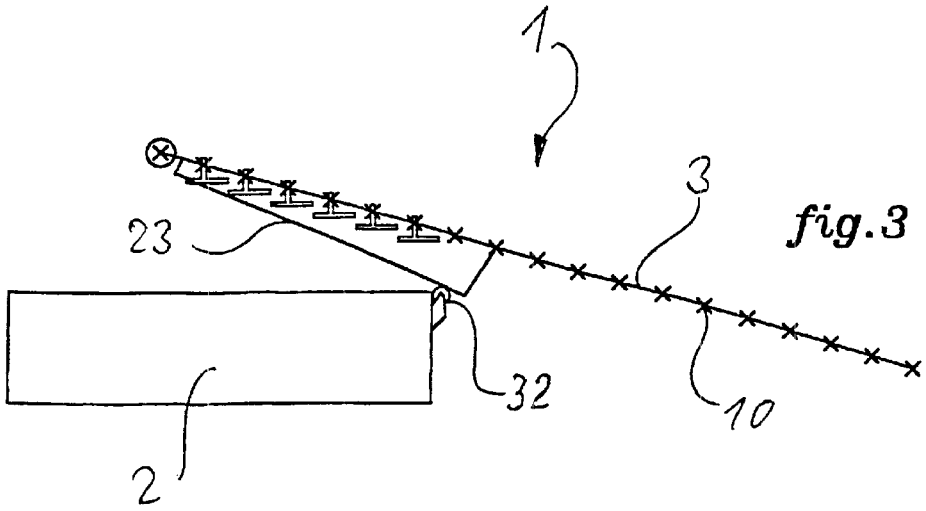
fig. 3

GANGWAY

CROSS REFERENCE TO RELATED APPLICATIONS

Applicant claims priority under 35 U.S.C. §119 of International Application No. PCT/DE00/01516, filed on MAY 14, 2000. Applicant also claims priority under 35 U.S.C. §120 of PCT/DE00/01516, filed on MAY 14, 2000. The international application under PCT article 21(2) was not published in English.

BACKGROUND OF THE INVENTION

The present invention relates to a so-called gangway that is particularly suited for embarking on ships that have to dock on a floating pontoon such as used, for example in seaports, where the tidal currents cause noticeable differences in the level of the pontoon in relation to the wall of the jetty.

Such a gangway is known in the prior art from DE 198 20 780.8. The known gangway is comprised of two parallel sides, on which steps are arranged with a defined spacing from each other, and on which handrails are movably hinged on both sides on a railing, so that the handrails and the sides form a parallelogram with each inclination and the sides each are supported at the lower end on a roller and rotatably secured at the upper ends, whereby the trapezoidal steps are flexibly suspended with a spacing from the sites in which the sides are secured. It was found that said known gangway is afflicted with the drawback that the runners, which are secured on the undersides of the sides, have the same track width as the sides over the full length. This may cause damage to the stairway, which, under normal operating conditions, compensates listings of the pontoon of up to 12° when listings of the pontoon in excess of 6° occur at high tide.

Furthermore, the known gangways are normally comprised of two sides arranged parallel with each other. The sides are secured in an articulated manner at the upper end in the wall of the jetty and supported at the lower end by two rollers. Said rollers move back and forth on the pontoon depending on the level of the seawater.

It is perceived to be a drawback in connection with the known gangways that their adaptation to the conditions of the gradient of the individual steps of the gangway cannot be carried completely when changes occur in the level, for example between the edge of the seashore and a floating pontoon due to the tides, so that the entrance steps on the pontoon and the exit steps on land have varying conditions of their respective gradients. This poses a heightened risk of tripping, which may lead to accidents and claims on regression. Furthermore, it is perceived as disadvantageous that only one railing post is arranged on the sides of each step in order to avoid that neighboring steps and posts of the railing come into contact with each other at all angles of inclination occurring during high tide and when the inclination of the gangway reverses. The resulting distance between the posts of the railing is distinctly greater than the maximum spacing of 12 cm permissible on land. The public, which is used to uniformly spaced steps that comply with the regulations on land, therefore finds it difficult to adjust to step conditions that are varying within the confines of a gangway. Due to the relatively wide spacing between the posts of the railing, a risk is posed especially for children who can easily step through between such posts.

Therefore, the problem of the invention is to provide a gangway that is safely guided at high tide in order to mechanically protect the sides and the steps against destruction.

Said problem is solved according to the invention with the characterizing features of the independent claims.

Additional features essential to the invention are specified in the dependent claims.

SUMMARY OF THE INVENTION

The gangway as it relates to the invention is comprised of two parallel sides, in which trapezoidal steps are suspended in a hinged manner with a spacing (R=s=K) from a fixed point, and a handrail is suspended for each step parallel with the sides, and the steps comprise at least two stages of the railing whose line of alignment is arranged parallel with the sides of the trapezoidal steps, whereby the railing post located closest to the shorter side of the, trapezoid has a concave type of bulging, and runners are arranged on the undersides of the sides at a defined acute angle ($\beta$) in relation to the longitudinal axes of the sides. Said runners are arranged in the lower area of the sides, and their mutual spacing (track width) (d) amounts to about half of the spacing (S) of the sides in the area serving as a support at high tide.

The sides are advantageously secured at the upper end of the wall of the jetty on a console, whereby the spacing K is effected by means of a bearing block. The lower ends of the sides are advantageously supported on rollers, which are rotatably supported in a U-shaped profile. In this way, and owing to the fact that the two sides are connected with each other in a fixed way, the stairway automatically exactly adapts to listings of the pontoon in the normal range of such listings.

The spacing (R) is formed on the steps in an advantageous manner by two tabs which are disposed at a right angle in relation to each other, whereby one of said tabs is connected with the step of the gangway in a fixed manner. The point of connection between the tab and the step is advantageously located with a defined spacing (E) from the longitudinal axis of the step, which takes into account unilateral out-of-center loads acting on the step, so that the step and its attached posts of the railing are jointly forming a stiff frame.

The individual steps are advantageously provided with a trapezoidal shape and a multitude of railing posts are arranged aligned in relation to the running direction in a way turned by a defined angle ($\alpha$), whereby the posts of the railing extend parallel with the slanted side of the trapezoid. In this way, the posts of neighboring steps are capable of being displaced by sliding in next to one another in the way of sliding blocks depending on the inclination of the stairway.

It is a special advantages that the railing post located closest to the shorter edge of the trapezoid comprises a concave bulging located in the lower area, the effect of it being that said post of the railing is not damaged by the longer edge of the trapezoid of the neighboring step when the inclination of the stairway reverses, on the one hand, and it is possible, on the other hand, to maintain the spacing of about 12 cm between the posts of the railing as required under the pertinent regulations.

The use of so-called self-aligning roller bearings represents another benefit. Said bearings are mounted on all steps and points of rotation of the handrail, so that no stiff connections of the sides of the stairway are created with the frames. This means that listings and inclinations of the pontoon are permitted to have some play within defined limits that are permissible under applicable regulations (up to 12° in sports facilities). This has the advantageous effect that the support rollers located at the lower end of the sides will never lift from the deck of the pontoon and that no slanted entrance is formed on the gangway.

Owing to the rigid connection between the posts of the railing and the steps, on the one hand, and the flexibility of the points of fixation on the sides and handrails on the other, a parallelogram is described between the handrails and the sides of the gangway with each inclination.

It is especially very advantageous if the gangway as defined by the invention is provided on the underside of each side with a runner that is arranged at a defined acute angle (β) in relation to the longitudinal side of the side, whereby the size of the angle (β) is dependent upon the general engineering design of the gangway. The underside of the runner is tangential in relation to the support roller; the angle β represents the flattest inclination of the stairway on which a person is able to walk, and is limited downwards by the thickness of the material of the lowermost step plus a few millimeters safety spacing. What is prevented by this measure is that the mechanism of the rollers and the steps will not be damaged by any negative inclination of the gangway, i.e. at high tide.

At high tide, each runner is resting on its own roller on the narrow side of the pontoon. With respect to its effective length, which results from the local conditions, its track width has to be selected adequately narrow that the maximum listing the pontoon can assume will list the free end of the stairway by 12° at the most.

The length of the runners arranged in the lower zone of the sides is advantageously a function of the respective side, or a function of the degrees of listing of the gangway most likely to occur.

The load-relieving effect of a space-keeping means (tie rod), which is mounted in the lower area of the runners, is advantageous for the overall stability of the gangway and the support of the steps.

The spacing of each individual runner or support surface r from the associated side is advantageously selected depending on the type of construction of the runners. The runners may advantageously be provided in the form of a solid profile having a cross section in the form of a "T".

It is an advantage that the spacing of each individual runner from each individual side increases from the lower end of the runner in the direction of and up to the upper end of the runner.

The cross sectional shape of the runners can be selected in any desired way and is substantially dependent on the requirements the gangway has to satisfy with respect to its stability.

BRIEF DESCRIPTION OF THE DRAWINGS

Now, the invention is explained in greater detail in the following with the help of drawings. In the drawings.

FIG. 2*a* is a schematic presentation of the entrance on the gangway (1) supported on a pontoon (2), on which the support rollers (8, 8') of the sides (3, 3') are supported.

FIG. 2*b* is a schematic representation of the exit of the gangway (1), whereby the sides (3, 3') are supported on the wall (13) of the jetty by means of a bearing block (25).

FIG. 3 is a schematic representation of the gangway (1) at high tide with a negative inclination, whereby a sliding runner (23) supports the entire gangway (1) on support rollers 32 located on the edge of a pontoon (2).

DETAILED DESCRIPTION OF THE INVENTION

Figure 1:
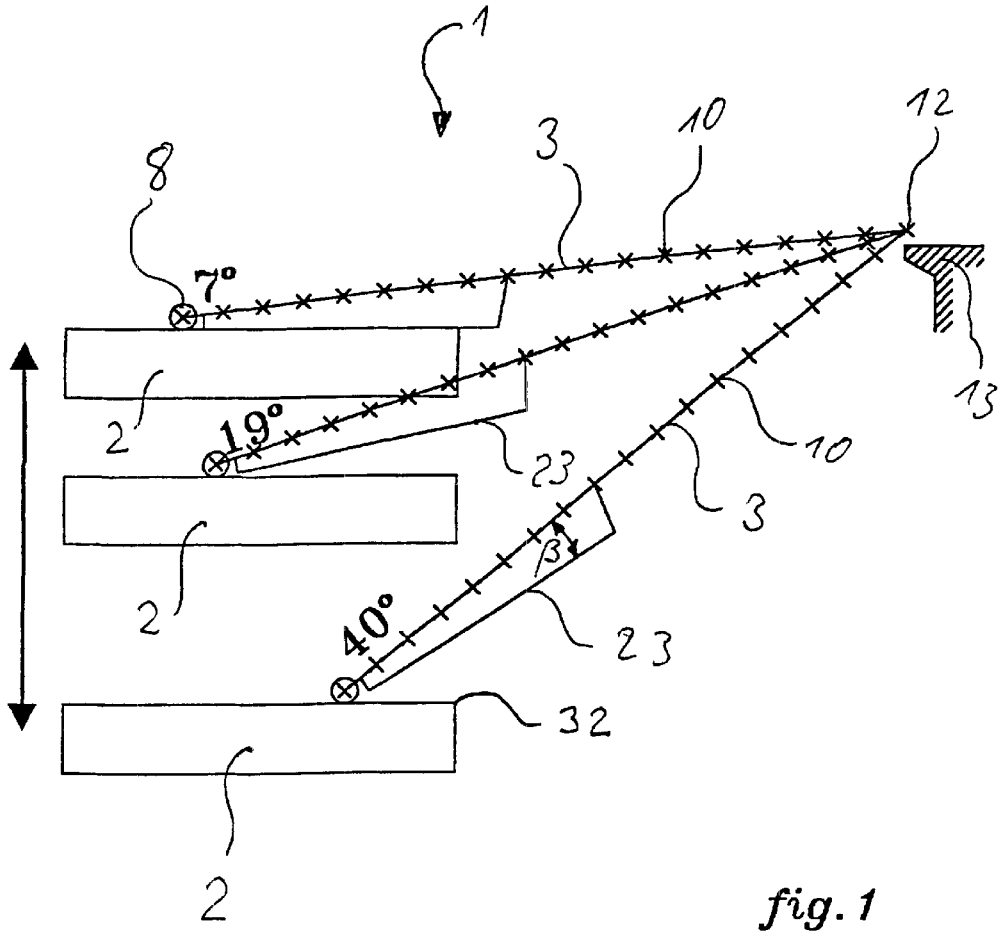
FIG. 1 is a schematic representation of the gangway (1) on a pontoon (2) and of a land-based point of support for different angles of inclination (7°; 19°; 40°).

Three possible conditions of inclination of the gangway 1 are schematically shown in FIG. 1. The gangway 1 is mounted articulated on the wall 13 of the jetty in the fastening site 12. The gangway 1 is comprised of the two parallel sides 3, 3' and a multitude of the steps 4, which all are arranged on the sides 3, 3' with the same spacing in the sites 10. At the lower end, the sides 3, 3' each are supported on a floating pontoon 2 on a roller 8, 8'. Different inclinations of the gangway 1 are caused owing to the different levels of the seawater at the tides occurring in a seaport. The point of support on the rollers 8 on the pontoon 2 rolls back and forth as the inclination changes depending on the level of the seawater. The present example shows three permissible positions of the gangway in which the latter can be used; the inclinations of said positions amount to 7°, 19° and 40°. The steps 4 are flexibly connected with the sides 3, 3' in the fixing points 10. In the center and upper areas of the gangway, a runner 23 is mounted in each of said areas at a defined angle (β) in relation to the longitudinal axes of the sides 3, 3'. Said runners rest flatly on the pontoon 2 at a degree of inclination of 7°. When the degree of inclination of the gangway 1 is flatter than that, the runner 23 lifts from the deck of the pontoon 2 and is then supported only in a site located on the edge 32 of the pontoon 2.

FIGS. 2*a* and 2*b* show the lower area of the gangway 1 and, respectively, the upper area with the associated support points on the pontoon 2 and on land on the wall 13 of the jetty. As the stepped-on surfaces of the individual steps 4, always have to remain horizontal irrespectively of the inclination of the stairway sides 3 and 3', they are flexibly suspended in the points of fixation 10 and 10', respectively. In the present representation, the two first steps 4 located in the lower area of the gangway 1 are symbolically provided on both sides with the three railing posts 9, 9' and 9", which converge at the top end in such a way that said three posts are flexibly joined with the handrail 5 in a point of rotation 10'. The steps 4 are connected with the railing posts 9, 9' and 9" in a fixed manner. The support rollers 8, 8' on the sides 3, 3' have a defined radius (R) that defines the spacing of the longitudinal axes of the sides from the deck of the pontoon 2. In the presence of the inclination of the gangway 1 shown, the runner 23 will not come into contact with the edge or roller 32 of the pontoon.

FIG. 2*b* shows the upper area of the gangway 1 in the zone of the support site 12 on land. The steps 4 are connected with the railing posts 9, 9' and 9" in a fixed manner and are flexibly mounted in the points 10 and 10'. In this way, a parallelogram is formed between the sides 3 and 3' and the handrails 5 and 5'—which are connected with each other by the railing posts 9—at any inclination assumed by the gangway 1. It is important that the sides are secured on the wall 13 of the jetty with a defined spacing (K) over land. It is also essential to the invention in this connection that the spacing (K) is the same as the support roller radius (R) of the support rollers 8 at the lower end of the gangway. Another important dimension is the spacing (S) between the top side 14 of the steps and the point of fixation 10 of the steps 4 on the sides 3 and 3'. The spacing (S) has to have the same dimension as the spacings (C), and all points of rotation 10, 10', R and K have to have the same distance between each other and need to be disposed in a straight line because a uniform gradient ratio between the shoreline and up to the pontoon is assured only with such a geometry, notably at any seawater level permitting a ship to navigate.

The spacing (A) of all points of rotation 10, 10', R and K was selected to amount to 31 cm in such a way that the gradient ratio of 23.8:20 is adjusted at low tide (40° inclination), which is just barely still manageable. At high tide (7° inclination), the gradient ratio changes to 30.9:3.8. Navigation is usually suspended at said level of the seawater. If the tide rises even further, the sides of the gangway are no longer supported on the rollers 8, but according to the invention rest on the runners 23, 23' which are secured on their undersides, in order to protect the mechanism of the steps. This situation is schematically shown in FIG. 3. When it is present in the position shown, the gangway 1 assumes a negative inclination, i.e. the deck of the pontoon 2 is located at a higher level than the edge of the wall 13 of the jetty, which causes the runners 23, 23' to slide on a roller 32 located on the edge of the pontoon 2. However, even inclinations in excess of 40° will not cause any destruction of the gangway 1.

Figure 4A:
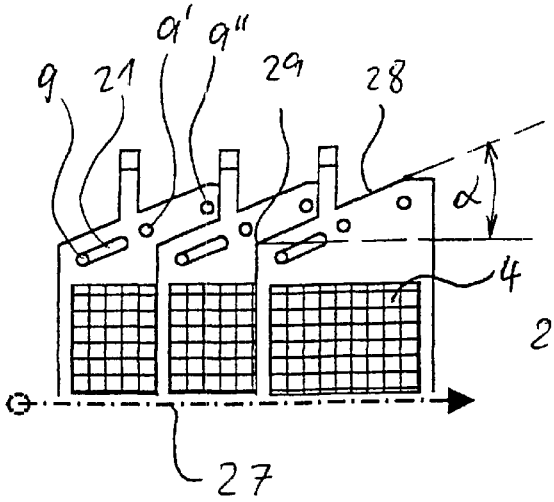
FIG. 4*a* is a top view of a plurality of steps (4), which are displaced by sliding one onto the top of the other in the presence of a steep inclination of the gangway (1).

FIG. 4*a* shows the position of the steps 4 in the presence of a relatively steep positive inclination. The steps 4 have a trapezoidal outline; a part thereof is shown in FIG. 4*a*. The angle between the running direction 27 and the side 28 of the trapeze amounts to approximately 23° in the present exemplified embodiment. The three railing posts 9, 9' and 9" are arranged parallel with the side 28 of the trapeze and are aligned with one another. The post 9 is provided with a bulging 21. Owing to the trapezoidal shape of the outline of the steps 4, the latter are capable of being displaced, sliding one onto another in the manner of a sliding block, and any contact of the steps 4 with the railing posts 9 is prevented when the inclination of the gangway reverses.

Figure 4B:
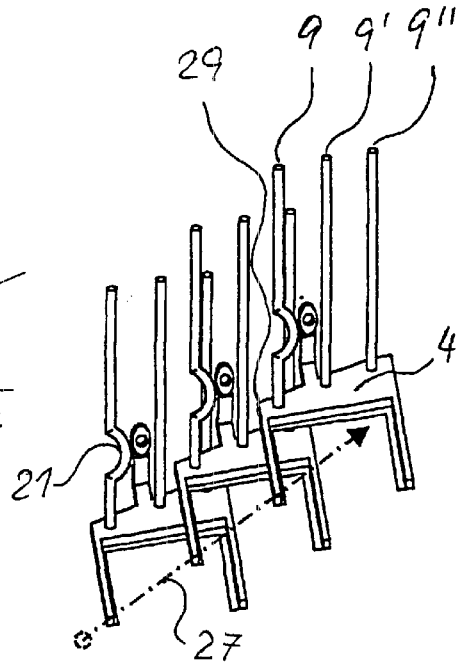
FIG. 4*b* is a schematic, perspective partial view of the steps (4) with the railing posts (9, 9', 9") in the presence of a relatively steep inclination.

FIG. 4*b* shows a perspective representation of one side of the steps 4 with the railing posts 9 for illustrating the position of the steps 4 at low tide and thus a steep position of the gangway 1. Owing to the trapezoidal shape of the outline of the steps 4, the front edge 29 of each step 4 slides past the railing posts 9".

The inclination reverses at high tide. The front posts 9 each are provided with a bulging 21, so that they will not be crushed by the rear edge 30 of the next step.

Figure 5A:
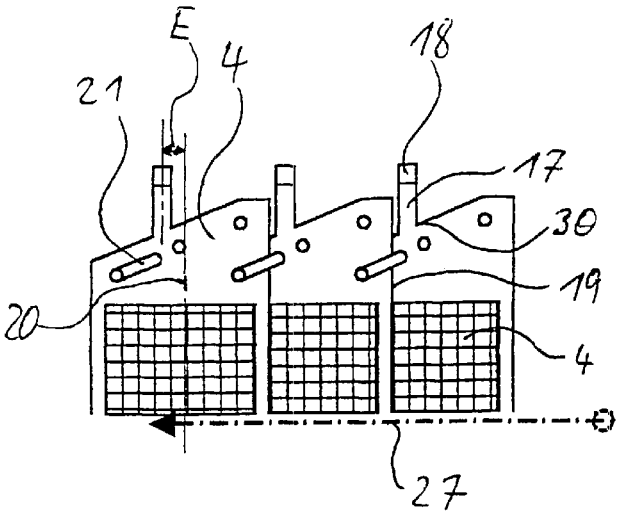
FIG. 5*a* is a top view of the displacement of the steps (4) in the presence of a negative inclination of the gangway (1), i.e. at high tide.
Figure 5B:
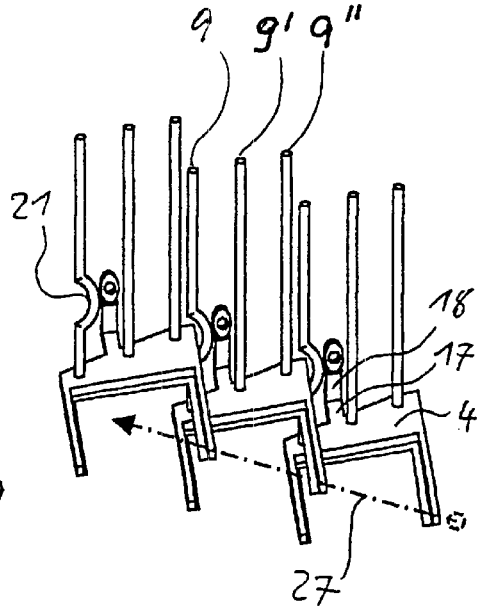
FIG. 5*b* is a perspective representation of the displacement of the steps (4) with the railing posts (9, 9', 9").

The corresponding positions of the steps 4 are shown in FIGS. 5*a* and 5*b*.

Figure 6A:
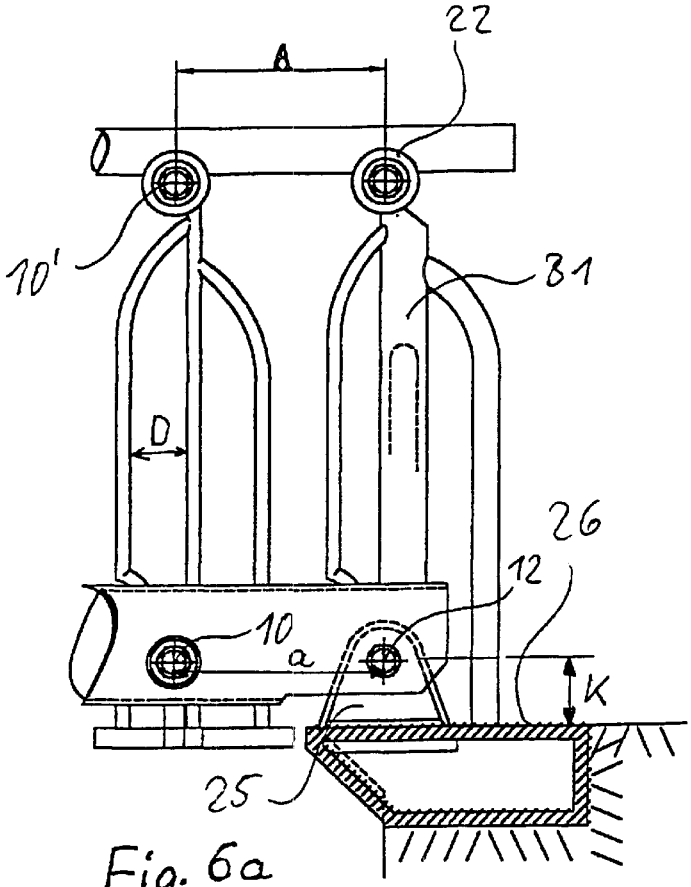
FIG. 6*a* is a side view of the upper area of the gangway (1) whose sides (3, 3') are secured by means of a bearing block 25) with a spacing (K) from the console (26).

FIG. 6*a* shows the side view of a part of the upper section of the gangway 1. The bearing block 25 is secured on a console 26. The sides 3 and 3' are supported in a rotating manner in the site 12 with a defined distance (K) from the surface of the console 26. The hollow profiles of the sides accommodate the point of fixation 10 of the steps 4 with a defined spacing (A). In connection with the type of fastening used in the site 12 it is important to avoid listings that may be caused due to movements of the floating body. The points of fixation 10 each are therefore equipped on the sides 3 and 3' with a so-called self-aligning roller bearing 22, which is not described in greater detail at this point. The self-aligning roller bearings 22 of the same type are installed in the sites of rotation 10' of the handrail, so that the steps 4 with the railing posts 9, 9' and 9", said steps being rigid per se, overall represent a flexible connection between the sides 3 and the handrails 5. By virtue of the fact that self-aligning roller bearings are employed in all points of rotation of the steps and the handrail, the goal so achieved is that the two sides absorb and compensate any lightly oblique position of the pontoon by two inclinations. This means that the rollers 8 located at the foot points of the sides will never lift from the deck of the pontoon 2.

Figure 6B:
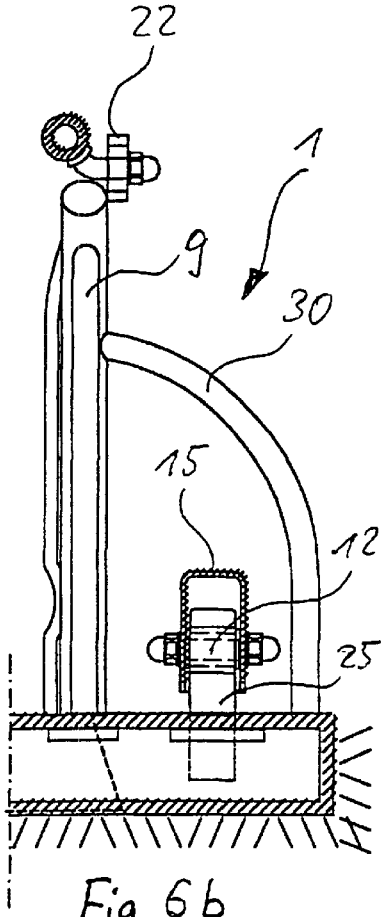
FIG. 6*b* shows the upper part of the gangway (1) in the running direction.

The railing posts 9 and the point of fixation 12 are shown in FIG. 6*b* in the running direction. The bearing block 25 projects into the U-profile of the sides and supports the sides in a rotating manner in the point of rotation 12. The U-profile is obtained by removing the lower side of a part of the hollow profile of the sides 3 and 3'. The spacing between the surface 26 of the console and the point of rotation 12 assume a predetermined quantity (K). Low-torsion evacuation of forces is achieved by installing the bearing block 25 in the U-shaped fork of the sides 3. The suspension of the gangway 1 on land is realized in the present case with the help of a flat steel box, which is not shown and described here in greater detail. Said steel box is referred to as a console. It is screwed to the wall of the jetty or a foundation or cast together with the reinforcement of such a foundation. The stairway exit and the two consoles, which are mounted on the bearing blocks 25, project beyond the edge of the shoreline. Recesses are disposed in between, into which flanks of the hollow profile are lowered under normal operating conditions of the gangway. The association of the plate of the console with the gangway 1 is established by a lattice grating not shown, said lattice grating being identical to the one used for the steps. The public is alerted to the gangway in this way one step ahead than it would be if a covering of an entirely different type were used. It is possible without any problems to equip the gangway at a later time with a lower handrail for children. By using the self-aligning roller bearings 22 in all points of rotation of the steps and handrails, and by omitting rigid connections of the sides of the stairway with the frames, it is possible to permit both sides to absorb listing of the deck by two types of inclination, and to turn the handrails sideways in accordance with the degree of listing. A strong support 30 that is connected with the end post 31 of the railing protrudes beyond the support point 12.

Figure 7:
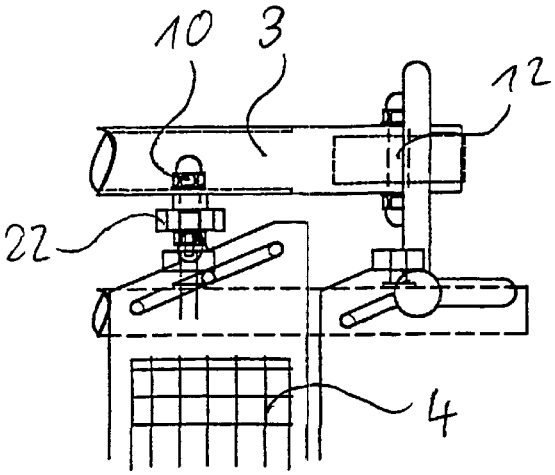
FIG. 7 is the top view of the upper part of the gangway with a step (4).

FIG. 7 shows the top view of the area of the point of rotation 12 where the sides 3, 3' are hinged. The self-aligning roller bearings 22 at the fixation points 10 are clearly visible there as well, said bearings being flexibly connected with the steps 4.

Figure 8:
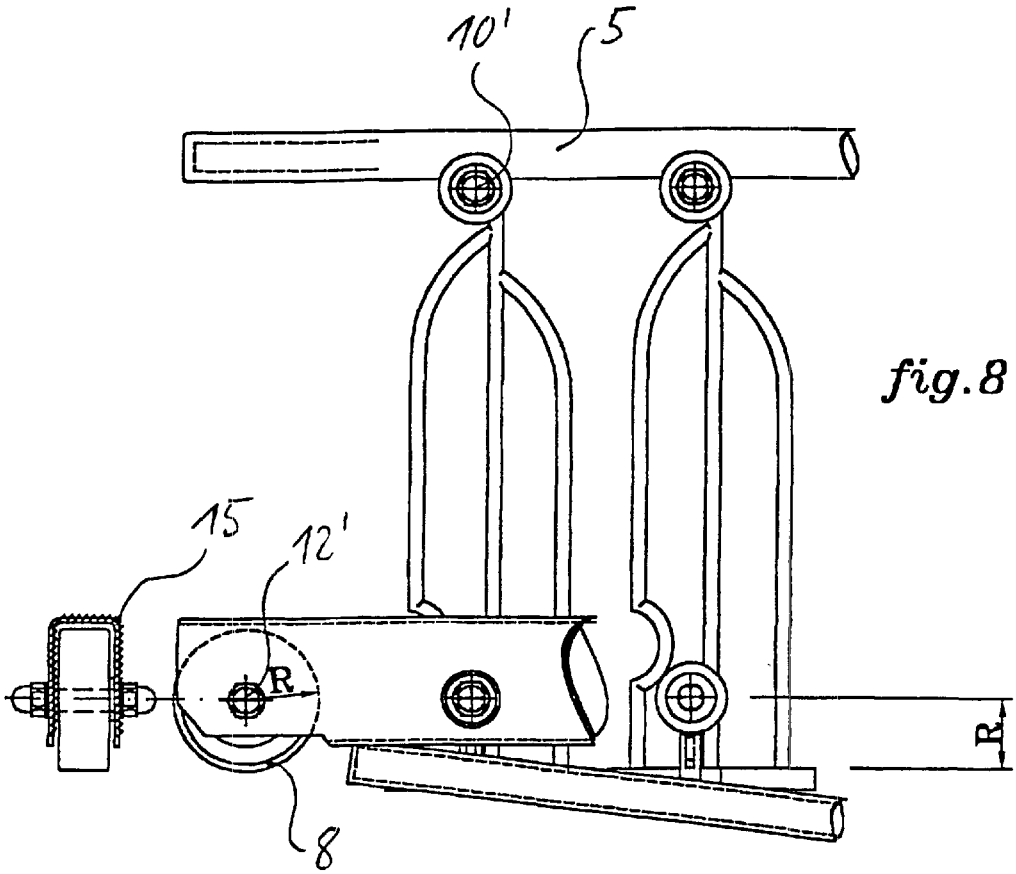
FIG. 8 shows the lower part of the gangway (1) by a side view.

FIG. 8 shows the side view of the lower area of the gangway 1. The rollers 8, 8' are mounted on the ends of the sides 3, 3' in a U-shaped profile 15. The radius (R) exactly corresponds with the spacing of the surface 14 of the step from the point of rotation 10 of the self-aligning roller bearing 22. The bulging 21 provided in the lower area of the railing post 9 serves the purpose of preventing the adjacent step 4 from coming into contact with the railing posts if a negative inclination of the gangway takes place. A runner 23 enclosing a defined angle (β) between the longitudinal axes of the sides is arranged below the sides 3, 3'. The angle (β) represents the minimum inclination of the gangway 1 and results from the spacing (A) and the thickness of the material of the first step 4. For example, with A=31 cm, the following follows from a minimum gradient of 3.77 cm of the steps in relation to one another:

$$\sin \beta = 3.77:31 \Rightarrow \beta = 7°.$$

Figure 9:
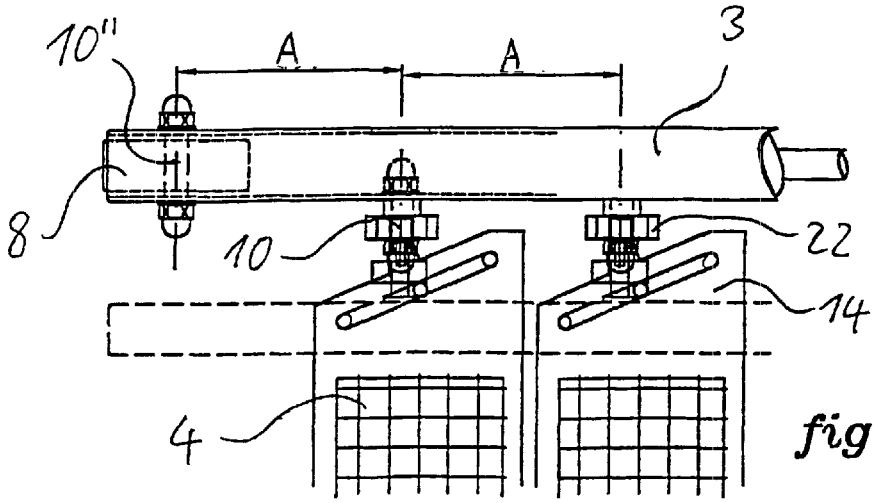
FIG. 9 is the top view of the lower partial area of the gangway (1) with two steps (4) and a support roller (8).

FIG. 9 shows the top view of the lower area of the gangway 1 by a cutout. It is essential to the invention that both the spacing (A) from the roller bearing 9" to the axis 10 of the first self-aligning roller bearing 22, and the spacing from the axis 10 of the first self-aligning roller bearing 10 to the second axis 10 of the self-aligning roller bearing 22 are constant, i.e. that said spacing dimensions are the same. Owing to the fact that all axes of rotation of the steps 4, the support wheels 8 and the sides of the stairway are arranged with a uniform spacing (A) in only one straight line; and that the dimension (R) of the radius of the support roller and the spacing of the top side of the step from the axis of rotation of the step are identical dimensions, a uniform ratio of the gradient is adjusted throughout, from a very flat to a very steep angle of inclination from the entrance step to the exit step. With the exemplified embodiment shown in the present figure, the gangway 1 is in a horizontal position. The gangway 1 is closed for traffic in said condition because the tide is high and the support roller 8 of the entrance of the gangway is no longer resting on the deck of the pontoon 2. Starting from said position, the spacing (D) between the railing posts 9, 9" may be greater than 12 cm because the gangway may no longer be used.

Figure 10A:
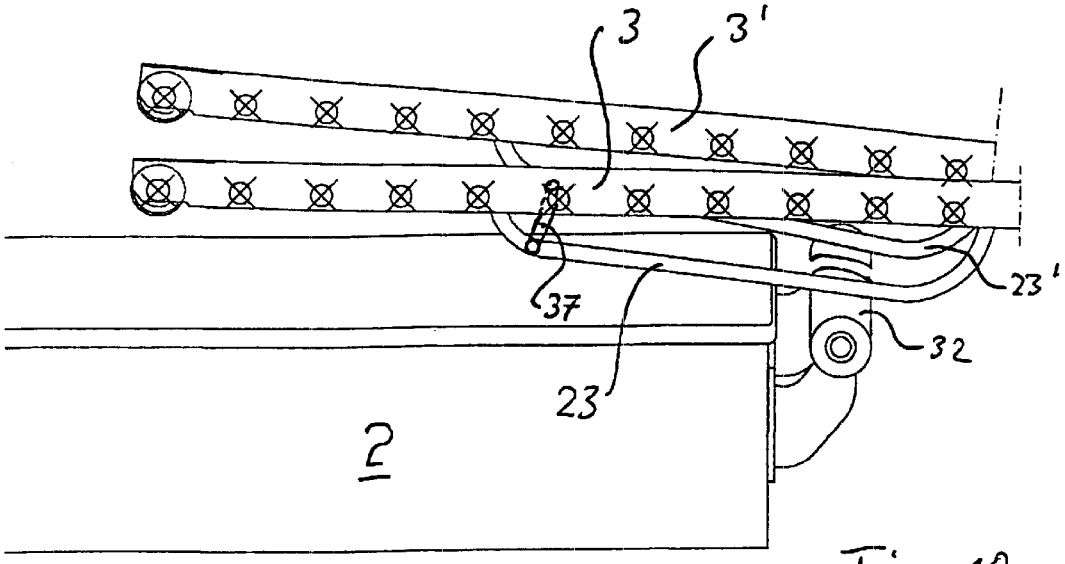
FIG. 10*a* is the schematic side view of a lower part area of the gangway (1) at high tide, when the runners (23, 23') are resting on the support rollers of the pontoon (2)

FIG. 10*a* shows a schematic side view of the gangway 1 at high tide. In the present situation, the two runners 23, 23'are resting on two sites on the support roller 32, which practically represents the edge of the pontoon 2. The runners 23, 23' are effectively supported only in a partial area of the runners, where the runners extend in a straight line. The line of extension of the straight-lined part of the runners 23, 23' tangentially touches the support rollers 8, 8' of the sides 3, 3' on the periphery of the support rollers 8, 8' of the sides 3, 3'. If the pontoon 2 is listing, the sides 3, 3' no longer remain parallel with each other, i.e. the sides have different inclinations that have to be absorbed by the play of the self-aligning roller 4=bearings 10. So as to make such different inclinations of the sides 3, 3' as minor as possible when the pontoon 2 is listing to a high degree, the effective points of support have to be converged as directly as possible, i.e. the closer the effective points of support of the runners 23, 23' are to each other, the greater the degree of listing of the pontoon 2 is permitted to become.

Figure 10B:
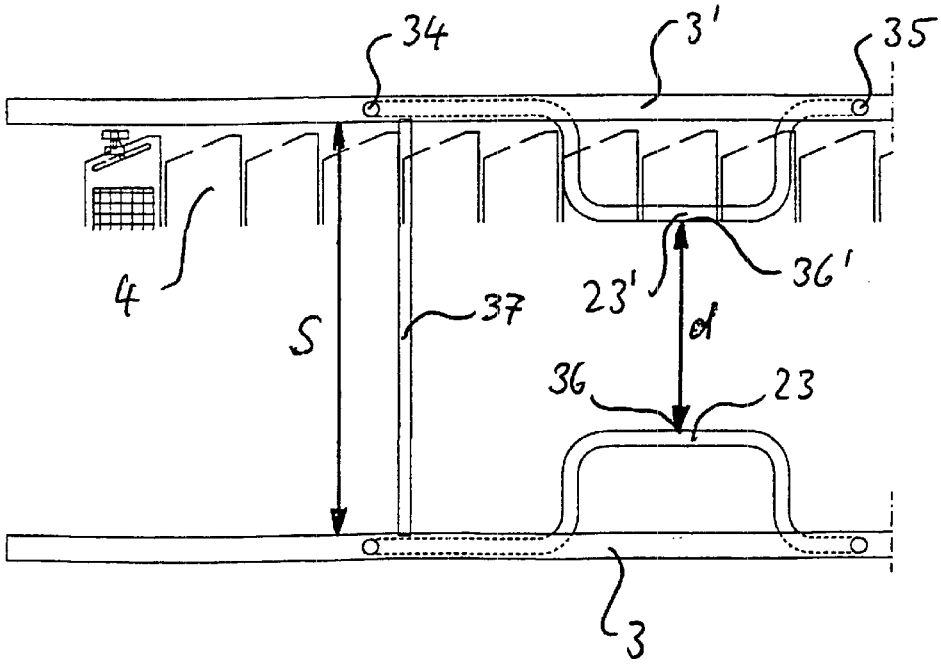
FIG. 10*b* is the top view based on FIG. 10*a*, showing a possible shape of the runners (23, 23').

FIG. 10*b* shows the top view based on FIG. 10*a*. In the present exemplified embodiment, the curved runners 23, 23' are secured on the sides in the two points 34, 35, and consist of solid profiles. The effective points of support 36, 36' are each aligned in lines that in turn extend parallel with each other, which, however, is not necessarily required for the runners 23 and 23' to function. A space-keeping means 37 (tie bar) is arranged in a suitable site on the runners, serving the purpose of maintaining the overall stability of the gangway 1. According to the invention, the spacing (d) between the effective support points 36, 36' of the runners 23, 23' is smaller than the spacing (S) between the sides 3, 3'.

What is claimed is:

1. A gangway comprising:

(a) a plurality of sides spaced apart from each other in a substantially parallel manner;, (b) a plurality of trapezoidal steps flexibly secured to said plurality of sides;

(c) a handrail;

(d) a plurality of railing posts flexibly secured to said handrail at one end, and rigidly secured to said plurality of trapezoidal steps at an opposite end, wherein at least one of said plurality of railing posts has a concave shaped portion in a region adjacent to said plurality of trapezoidal steps; and (e) a plurality of runners secured to an underside of said plurality of sides at a defined acute angle in relation to said plurality of sides;

wherein a distance between said plurality of runners along an axis parallel to said plurality of trapezoidal steps is smaller than a second distance between an associated plurality of sides along said axis parallel to said plurality of trapezoidal steps.

2. The gangway according to claim 1, wherein said plurality of trapezoidal steps is rotatably secured to said plurality of sides and said plurality of railing posts is rotatably secured to said handrail at one end.

3. The gangway according to claim 1, wherein said plurality of runners are flexibly connected to each other by means of a spacer.

4. The gangway according to claim 3, wherein said spacer is arranged on a lower end of said plurality of runners.

5. The gangway according to claim 1, wherein said plurality of runners have a plurality of individual points of support and wherein a spacing of each individual point of support from an associated plurality of sides is not constant.

6. The gangway according to claim 5, wherein said spacing of each individual point of support from an associated plurality of sides increases from one end of said plurality of runners to another end of said plurality of runners.

7. The gangway according to claim 1, wherein said plurality of runners has a round cross section.

8. The gangway according to claim 1, further comprising a support roller that is rotatably mounted to an end of said plurality of sides.

9. The gangway according to claim 8, wherein said support roller, rotatably mounted to an end of said plurality of sides, is mounted in a U-shaped profile.

10. The gangway according to claim 8, wherein said support roller, rotatably mounted to an end of said plurality of sides, has a line of extension which tangentially touches an individual point of support of said plurality of runners.

11. The gangway according to claim 1, wherein said plurality of sides have an upper end that is flexibly secured to a console, which is rigidly secured to a wall of a jetty.

12. The gangway according to claim 11, wherein said upper end of said plurality of sides flexibly secured to said console, forms a point of rotation with a spacing from said console which is equal to a radius, of a support roller, rotatably mounted to a lower end of said plurality of sides.

13. The gangway according to claim 1, further comprising a first tab, a second tab, and a flexible connecting element, wherein said first tab is rigidly secured to said plurality of trapezoidal steps; said second tab is disposed at a right angle to said first tab and rigidly secured to said first tab, and said flexible connecting element is coupled to said second tab and to said plurality of sides, wherein a defined spacing is formed between a top side of said plurality of trapezoidal steps and a point of rotation of said plurality of trapezoidal steps.

14. The gangway according to claim 13, wherein said first tab is located at a fixed distance from a longitudinal axis of said plurality of trapezoidal steps.

15. The gangway according to claim 1, wherein said plurality of railing posts are arranged in a substantially parallel manner with a non-parallel side of said plurality of trapezoidal steps to which said,plurality of railing posts are rigidly secured.

16. The gangway according to claim 1, further comprising a plurality of self-aligning roller bearings, wherein said plurality of trapezoidal steps is flexibly secured to said plurality of sides with said plurality of self-aligning roller bearings and wherein said plurality of railing posts is flexibly secured to said handrail with said plurality of self-aligning roller bearings.

17. The gangway according to claim 1, wherein each of said plurality of railing posts is located at a distance of not greater than 12 cm from each adjacent railing post.

18. A method for producing a gangway for use at variable angles of inclination, comprising:

(a) flexibly securing a plurality of trapezoidal steps to a plurality of sides spaced apart in a substantially parallel manner;

(b) rigidly securing said plurality of trapezoidal steps to one end of a plurality of railing posts, wherein at least one of said plurality of railing posts has a concave shaped portion in a region adjacent to said plurality of trapezoidal steps;

(c) flexibly securing an opposite end of said plurality of railing posts to a handrail; and (d) securing a plurality of runners to an underside of said plurality of sides at a defined acute angle in relation to said plurality of sides;

wherein a distance between said plurality of runners along an axis parallel to said plurality of trapezoidal steps is smaller than a second distance between an associated plurality of sides along said axis parallel to said plurality of trapezoidal steps.

* * * * *